United States Patent [19]

Moore

[11] Patent Number: 4,660,732

[45] Date of Patent: Apr. 28, 1987

[54] TAMPER EVIDENT SEAL

[76] Inventor: Gerald L. Moore, 1120 Corvallis Dr., San Jose, Calif. 95120

[21] Appl. No.: 866,468

[22] Filed: May 23, 1986

[51] Int. Cl.[4] ..... B65D 41/02

[52] U.S. Cl. ..... 215/232; 215/365; 156/69; 206/459; 206/807

[58] Field of Search ..... 215/232, 365, 203; 156/69; 206/459, 807

[56] References Cited

U.S. PATENT DOCUMENTS 590,875 9/1897 Bhise ..... 215/365

4,550,842 11/1985 Cummings ..... 215/232

4,558,794 12/1985 Towns ..... 215/203 X

*Primary Examiner*—Donald F. Norton

*Attorney, Agent, or Firm*—Gerald L. Moore

[57] ABSTRACT

A tamper evident container (10) having an opening (15) to allow access to the container contents. Undulations (16) are formed in the rim (14), and a seal (18) is glued across the opening to cause destruction of the seal in gaining access to the container contents. A replica (24) is illustrated on the bottle label for comparison to the seal (18) on the bottle for assurance the container has not been opened.

4 Claims, 3 Drawing Figures

TAMPER EVIDENT SEAL

FIELD OF THE INVENTION

This invention relates to a seal and method of sealing a container to indicate the non violation of the container interior.

BACKGROUND OF THE INVENTION

Tamper evident seal closures are becoming a necessity for a wide range of containers for the dispensing of products such as medicines primarily intended for internal consumption. Such products also include drugs and food products of various kinds. In the past tamper evident closures have primarily included the sealing of the mouth of the container with a non-stretchable material such as aluminum foil which is cemented firmly to the rim around the container opening. Thereafter a cap is placed over the seal and the container is placed in a carton that is cemented shut. Distinctive markings may or may not be printed on the foil.

With the seal cemented to the lip of the opening there remains the possibility that it can be removed sometimes without destruction by the careful cutting or interruption of the cement between the container lip and the seal. Even if the seal must be destroyed with removal, it is also possible to replace the seal with a foil cut to size, and even if the distinctive markings on the seal are not duplicated, the user has no way of knowing what the original seal looked like. Thus, because of a lack of information concerning the original seal and because of the relatively simple construction of the seal the container interior can be violated and a seal replaced without being evident to the ultimate user.

It is the purpose of the present invention to provide a seal which will clearly show to the ultimate user that it has been tampered with.

SUMMARY OF THE INVENTION

A seal and method of sealing a container having a top opening with a rim extending therearound comprising the formation of undulations in the rim and the placement of a seal across the opening and glued to the rim in a manner to conform with the undulations. Printed on the seal are distinctive markings and place on the outside of the bottle are instructions for the user and a replica of the seal for the potential user to compare with the seal on the container once the cap is removed to determine if the seal has been replaced or tampered with.

DESCRIPTION OF THE INVENTION

Figure 1:
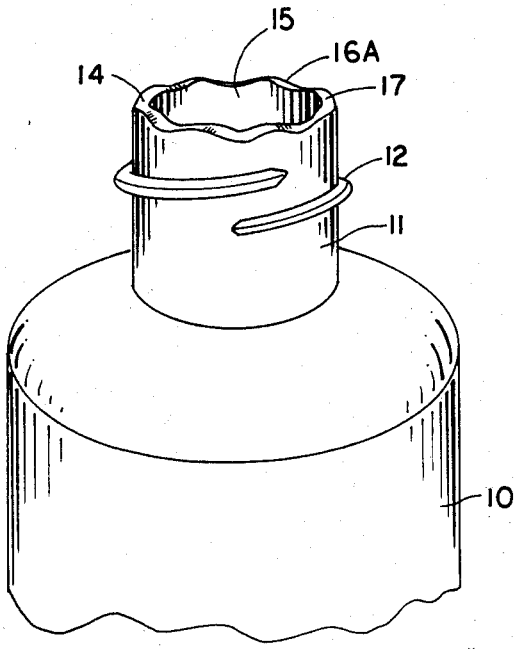
FIG. 1 is a perspective view of the top end of a bottle showing undulations in the rim.
Figure 2:
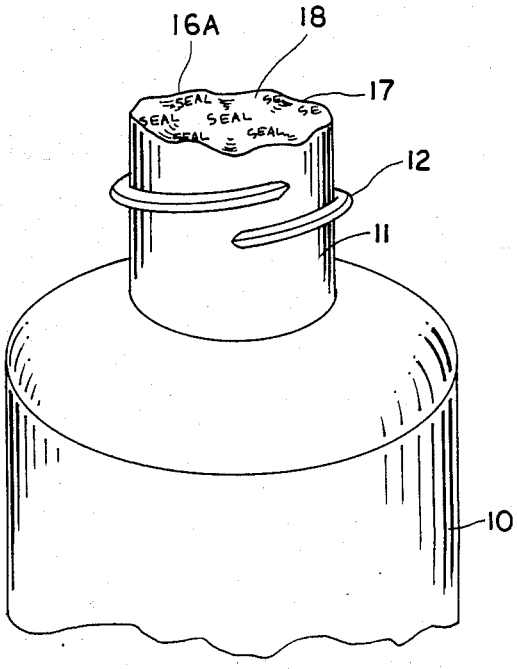
FIG. 2 is a view of FIG. 1 showing the seal in place on the undulations.
Figure 3:
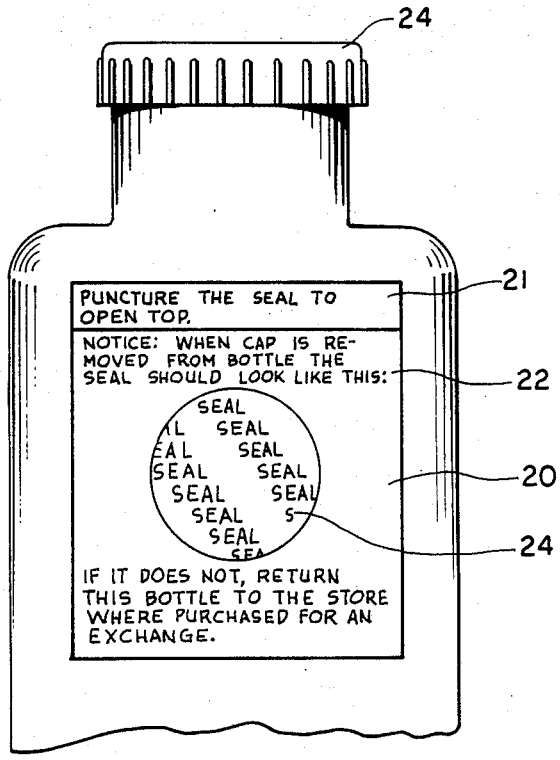
FIG. 3 is a view of the bottle showing the instructions on the side of the bottle with a picture showing the seal as it should appear when the cap is removed.

In FIG. 1 is shown a first embodiment of the invention comprising the bottle 10 having formed on the top end a neck 11 forming an outer thread 12 on which a bottle cap (not shown) is screwed to seal the bottle closed. A rim or lip 14 extends around the opening 15 through which the contents of the bottle are emptied. Usually such bottles are plastic or glass, preferably transparent, for holding medicines and the like. For better anti-tampering qualities it is preferred the bottle be made of transparent glass. A seal is usually glued to the rim 14.

In accordance with the first feature of the invention, the rim of the bottle is formed of undulations 16 having high points 16*a* and valleys 17 positioned alternately around the rim. A seal 18 is glued to the undulations to close the opening unless the seal is destroyed. These undulations preferably are thicker than the blade of a razor blade and the like such that if one attempts to remove the seal glued to the bottle rim it would be difficult to move the knife into the undulations and remove the seal intact. In other words whereas in the past with a planar top surface on the rim 14, a razor blade might possibly be inserted between the seal which is usually made of a foil and the bottle lip and the glue layer cut to remove the seal in one piece. With the undulations this is next to impossible because the blade will not fit into the valleys in a manner to reach the width of the lip and cut the glue layer.

In accordance with a second feature of the invention there is placed on the side of the bottle a label 20 having instructions 21 to the potential user on how to perforate the seal. Additionally, there is included instructions on how the seal should appear when the cap 24 is removed. The cap is screwed onto the threads 12 and is easily removed by hand. The user can then compare the seal glued across the rim 14 to the replica 24 shown in the instructions. The user is thus assured that the seal has not been removed and replaced by the fact that a comparison of the appearance of the seal and how the seal should appear is afforded the user before the contents of the bottle are used.

I claim:

1. The method of forming a tamper evident seal for a container having an opening connecting with the container interior surrounded by a lip, said method comprising the steps of:

forming in the lip a plurality of undulations, and gluing to said lip undulations a seal extending across the container opening thereby to cause destruction of said seal when the container opening is opened to gain access to the container interior.

2. The method as defined in claim 1 including the step of including on the outside of the bottle a replica of the seal as it appears before the container is opened to gain access to the container interior.

3. A tamper evident container comprising:

a container body forming an internal cavity, an opening through said body surrounded by a lip, a plurality of undulations formed in the surface of said lip, and a seal glued to said lip in a manner to conform to said undulations so as to make removal of said seal from said lip without destruction of said seal more difficult.

4. The method of seating a container to prevent tampering with the contents of the container interior comprising the steps of:

forming in the container an opening to allow access to the container interior, fastening across the opening a seal to prevent access to the container interior without destruction of said seal, and placing on the container exterior a replica of the seal so the user can compare the seal with the replica to assure that the original seal has not been removed and replaced.

* * * * *